United States Patent [19]

Schröder et al.

[11] Patent Number: 4,602,688

[45] Date of Patent: Jul. 29, 1986

[54] DEVICE FOR PERFORMING REMOTELY-MANIPULATED MAINTENANCE WORK IN A SHIELDED CELL

[75] Inventors: Günter Schröder, Minden-Dützen; Günter Dudek, Visselhövede, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 647,624

[22] Filed: Sep. 5, 1984

[30] Foreign Application Priority Data

Sep. 5, 1983 [DE] Fed. Rep. of Germany ..... 3331975

[51] Int. Cl.[4] ..... E21B 15/04; B25B 17/00

[52] U.S. Cl. ..... 173/42; 173/81; 81/57.11

[58] Field of Search ..... 173/39, 8, 9, 42, 81, 173/20, 12, 151; 81/481, 467, 57.11

[56] References Cited

U.S. PATENT DOCUMENTS

| | | | |
|---|---|---|---|
| 2,606,472 | 8/1952 | Curtis et al. | 81/57.11 |
| 2,938,534 | 5/1960 | Bos | 173/151 X |
| 4,155,278 | 5/1979 | Estok | 81/57.11 |

*Primary Examiner*—E. R. Kazenske
*Assistant Examiner*—Willmon Fridie, Jr.
*Attorney, Agent, or Firm*—Walter Ottesen

[57] ABSTRACT

The invention is directed to a device for performing remotely-manipulated maintenance work with a motor-driven tool such as an impact wrench or the like on conduits and process components arranged in a shielded, radioactively-ladened cell. The device includes an impact wrench mounted in a carrier frame. The impact wrench can be remotely-controlled in a vertical or a horizontal working position and is movable on the cable hoist of a remotely-controlled crane. The carrier frame is provided with motor-driven retractable and extendable torque bracing spindles on its longitudinally extending sides to prevent twisting of the impact wrench and carrier frame in the vertical working position about the cable of the cable hoist.

5 Claims, 2 Drawing Figures

DEVICE FOR PERFORMING REMOTELY-MANIPULATED MAINTENANCE WORK IN A SHIELDED CELL

FIELD OF THE INVENTION

The invention relates to a device for performing remotely-manipulated work on conduits and process components in a shielded, radioactively-ladened cell. The device is adapted to hold a motor-driven tool such as an impact wrench in vertical and horizontal positions. The device is supported for movement on the cable hoist of a remotely-controlled crane.

BACKGROUND OF THE INVENTION

It has been proposed that the chemical process installations of a nuclear reprocessing facility may be arranged in a shielded large-area cell. The maintenance work on the process components and conduits must be carried out in a remotely-controlled mode because of the radioactive condition of the cell and because of the need for a short shutdown time of the equipment in the cell. Portable remotely-manipulated machines are provided for that purpose.

A tool for the above-mentioned remote manipulation is an impact wrench with which conduit connections can be disconnected or connected. For this work, it is desirabe that the impact wrench be used in a horizontal operating position and in a vertical operating position as required. In order to achieve this, the impact wrench is mounted in a carrier frame which has either two suspension eyes disposed at different locations or a tilting mechanism for bringing the impact wrench into the two operating positions. The carrier frame is suspended on the crane hook of a cable hoist of a remotely-controlled movable crane. The impact wrench is moved to the work position by means of the crane.

It was found that the impact wrench rotates about the cable hoist when the impact wrench operates in the vertical position. The reaction torque results in a rotary movement of the impact wrench. The rotary movement of the impact wrench twists the crane cable on which the impact wrench is suspended. This causes the cable hoist to lift so that the socket of the impact wrench lifts away from the nut and comes out of engagement therewith.

SUMMARY OF THE INVENTION

It is an object of the invention to provide a device of the kind described above that minimizes the rotary movement of the impact wrench when utilized in the vertical operating position.

The device of the invention is for performing remotely-manipulated maintenance work with a motor-driven tool such as an impact wrench or the like on conduits and process components arranged in a shielded, radioactively-ladened cell. The device is supported by support means such as a wire-rope hoist of a remotely-controlled crane. The tool has an output spindle defining a longitudinal axis and develops a torque when in use. The device includes: frame means suspendible from the support means for holding the tool; positioning means for selectively positioning the tool in vertical and horizontal working positions; and, torque bracing means for developing a reaction torque to brace the frame means against the torque developed by the tool during use thereof.

The torque bracing means can include first component bracing means mounted on one side of the frame means and second component bracing means mounted on the other side of the frame means. Each of the component bracing means includes an elongated torque brace movably mounted on the frame means; and, motor means operatively connected to the elongated torque brace for extendably and retractably moving the latter with respect to the frame means in the direction of the longitudinal axis of the output spindle of the tool, whereby the elongated torque brace comes into contact engagement with a conduit or component for bracing the frame means against the torque developed by the tool.

The two elongated torque braces are arranged on respective sides of the frame for holding the tool and can be extended by motor means. These torque braces prevent a major rotary movement of the impact wrench because one of the torque braces comes to lie against a neighboring conduit, component or the like in correspondence to the direction of rotation of the socket of the wrench.

The process components in a large-area cell of a nuclear reprocessing facility are usually disposed in a very close and compact arrangement in racks. From a curtain array of conduits extending behind the racks, a plurality of conduits lead to the components in the racks. Therefore, there is always the conduit of the flange which is just now to be fastened or another component against which the torque brace can dissipate its torque.

BRIEF DESCRIPTION OF THE DRAWING

The invention will now be described with reference to the drawing wherein.

DESCRIPTION OF THE PREFERRED EMBODIMENTS OF THE INVENTION

Figure 1:
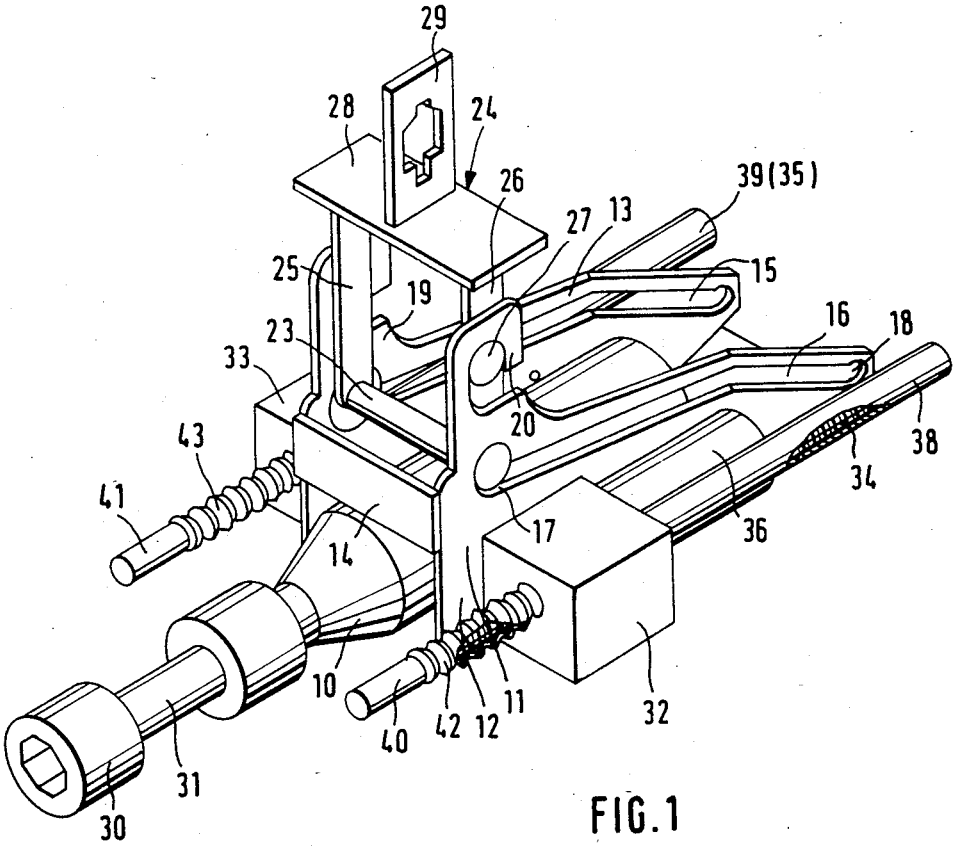
FIG. 1 is a perspective view of the device according to the invention holding an impact wrench in the horizontal working position and incorporating tilting means including guide slots formed in the frame of the device; and, FIG. 2 is a perspective view of the device of the invention with the impact wrench shown in the vertical direction and equipped with torque braces in the form of threaded spindles.

An electrically operated impact wrench 10 is mounted in a carrier frame 11. The carrier frame 11 includes two plate-like side pieces 12 and 13 which are threadably fastened to the impact wrench 10. The front ends of the side pieces 12 and 13 are joined together by a transverse strut 14 which is held in position with the aid of threaded fasteners.

The side pieces 12 and 13 have mutually aligned slotted slide tracks 15 and 16 which interconnect the two limit positions 17 and 18. The limit position 17 is at the center of gravity of the composite assembly of carrier frame 11 and impact wrench 10 for the horizontal working position of the assembly shown in FIG. 1; whereas, the limit position 18 is at the center of gravity of the composite assembly for the vertical working position as shown in FIG. 2. Thus, the limit position 18 for the vertical location of the center of gravity is disposed at the rearward, flattened end of the side pieces 12 and 13 and the horizontal limit position 17 is in the front upper part of the side pieces 12 and 13. From the horizontal limit position 17, the slide tracks 15 and 16 extend at an inclined angle relative to the longitudinal axis of the impact wrench 10 to the vertical limit position 18. The slide tracks 17 and 18 each have two linear segments defining respective slope angles with a plane containing the longitudinal axis of the impact wrench 10.

Hook-like openings 19 and 20 are provided on the side pieces 12 and 13, respectively, above the horizontal limit position 17. The hook-like openings 19 and 20 open in a downward direction as shown.

The two ends of a guide pin 23 displaceably engage the slide tracks 15 and 16. The guide pin 23 is mounted on the lower end of a yoke 24. Guide rollers 27 are mounted on the sides of legs 25 and 26 of the yoke 24 at the mid region thereof. When the yoke 24 moves into the horizontal limit position 17, the guide rollers 27 move into and engage the hook-like openings 19 and 20 as shown in FIG. 1.

The legs 25 and 26 are connected together at their upper ends by a transversely disposed carrier plate 28. An eyelet plate 29 is mounted at the mid region of carrier plate 28 for connection to the load hook of a crane. The entire device with the impact wrench 10 can thus be suspended on a crane hook of a wire-rope block.

Figure 2:
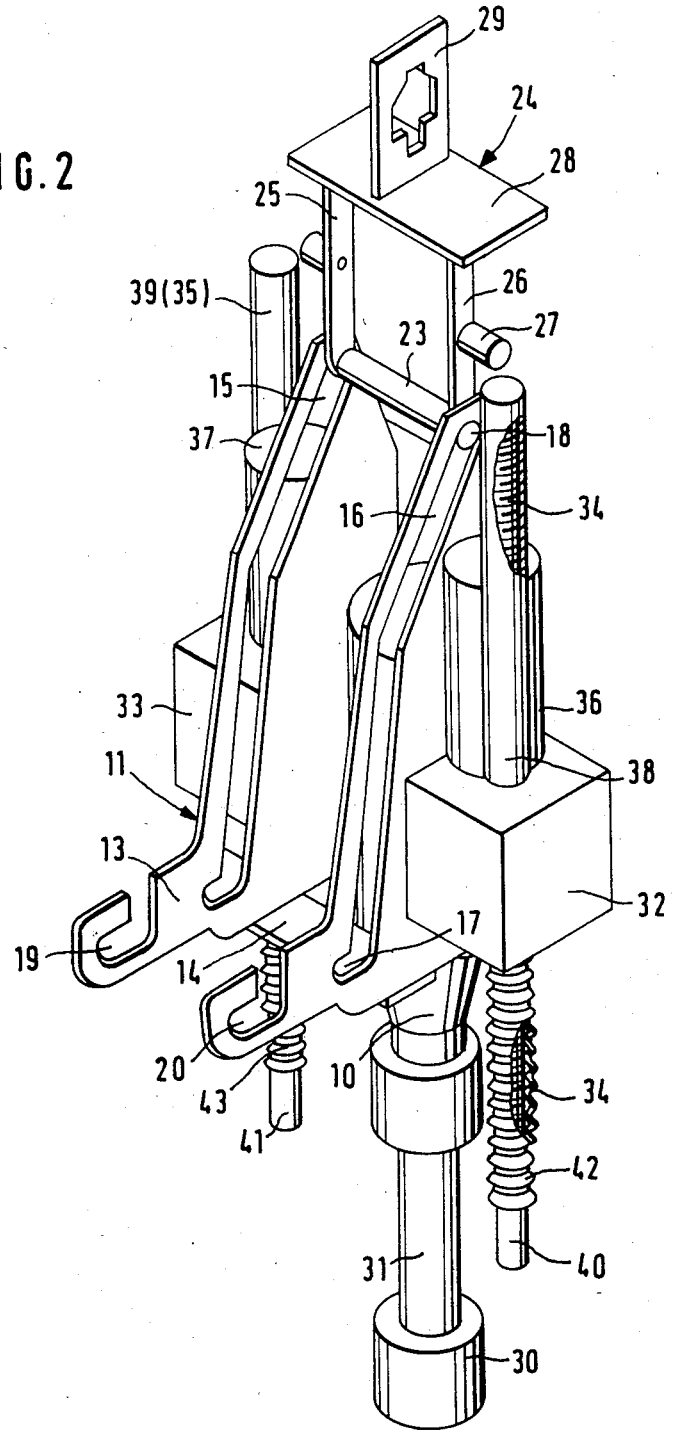

The side pieces 12 and 13 and the transverse strut 14 conjointly define the carrier frame 11 which, together with the yoke 24 and guide pin 23, defines the slot-guided tilting mechanism for enabling the impact wrench 10 to be moved between the horizontal and vertical working positions shown in FIGS. 1 and 2, respectively.

The impact wrench 10 has an impact socket 30 for positively engaging threaded bolts or nuts on the end of its output spindle 31.

Gear means in the form of gear blocks 32 and 33 are mounted on the carrier frame 11 at the right-hand side and the left-hand side thereof, respectively. Threaded spindles 34 and 35 are arranged in gear blocks 32 and 33, respectively, so as to be extendable and retractable in the direction of their respective longitudinal axes. The threaded spindles 34 and 35 are driven by electric motors 36 and 37, respectively, secured to the gear blocks 32 and 33. Outside the respective gear blocks 32 and 33, the threaded spindles 34 and 35 are protected from mechanical damage by respective protective tubes 38 and 39. The tubes 38 and 39 are mounted on the respective gear blocks 32 and 33 on the sides thereof facing away from the front operating side.

The threaded spindles 34 and 35 have long abutment portions 40 and 41 at the outward ends thereof facing toward the surfaces with which they will abut during use. Bellows-like coverings 42 and 43 are mounted on the forward ends of threaded spindles 34 and 35, respectively. The forward ends of the coverings 42 and 43 are attached at the respective abutment portions 40 and 41; whereas, the rearward ends of the coverings 42 and 43 are secured to the respective gear blocks 32 and 33.

The operation of the device of the invention will now be described.

After the impact wrench device has been moved to the work location by means of a remotely-controlled crane and is in a vertical working position (see FIG. 2), either the righthand or the lefthand threaded spindle 34, 35 is moved in the direction of the threaded fastener which is to be tightened or loosened in a flange connection of a conduit, for example. The socket 30 of the impact wrench 10 engages the fastener and the wrench 10 is actuated. Depending on the direction of rotation of the output spindle 31 of the impact wrench 10 (disengaging or engaging a fastener of the conduit flange), the operator will selectively move either the threaded spindle on the right-hand side of the device or the threaded spindle on the left-hand side of the device towards the region of operation of the impact wrench 10 by the electric drive motor 36 or 37 under remote control until it comes into contact engagement with a convenient surface against which it braces to provide a counter-torque to the action of the impact wrench 10.

Thus, for the above situation, the extended threaded spindle 34 or 35 bears against the conduit associated with the flange during the time that the impact wrench 10 is operating and in that way prevents the impact wrench device and the crane hook from twisting about the cable hoist. After the fastener has been released or tightened, the operation is concluded. The extended threaded spindle 34 or 35 is retracted into its starting position by reversing the direction of rotation of the electric motor 36 or 37, respectively.

In the starting position referred to above, the threaded spindles 34 and 35 are accommocated over the greater part of the length thereof in the protective tubes 38 and 39. The bellows-like coverings 42 and 43 are compressed against the abutment portions 40 and 41 of the threaded spindles 34 and 35.

It is understood that the foregoing description is that of the preferred embodiments of the invention and that various changes and modifications may be made thereto without departing from the spirit and scope of the invention as defined in the appended claims.

What is claimed is:

1. Device for performing remotely-manipulated maintenance work with a motor-driven tool such as an impact wrench or the like on conduits and process components arranged in a shielded, radioactively-ladened cell, the device being supported by support means such as a wire-rope hoist of a remotely-controlled crane, the tool having an output spindle defining a longitudinal axis and developing a torque when in use, the device comprising:

frame means suspendible from said support means for holding the tool;

positioning means for selectively positioning said tool in vertical and horizontal working positions; and, torque bracing means for developing a reaction torque to brace said frame means against the torque developed by the tool during use thereof, said torque bracing means including first component bracing means mounted on one side of said frame means and second component bracing means mounted on the other side of said frame means; each of said component bracing means including an elongated torque brace movably mounted on said frame means; and, motor means operatively connected to said elongated torque brace for extendably and retractably moving the latter with respect to said frame means in the direction of said longitudinal axis whereby said elongated torque brace comes into contact engagement with a conduit or component for bracing said frame means against the torque developed by the tool.

2. The device of claim 1, said frame means including two side plates for accommodating the tool therebetween; each of said component bracing means including mounting means arranged on one of said side plates; said elongated torque brace being a threaded spindle movably mounted in said mounting means; said motor means being an electric motor flange-mounted to said one side plate; and, gear means for connecting said spindle to the output shaft of said electric motor.

3. The device of claim 2, each of said component bracing means further including a protective tube mounted on said mounting means for protecting and accommodating said threaded spindle therein.

4. The device of claim 2, each of the threaded spindles having a front end portion for contact engaging a conduit or component for bracing said frame means against the torque developed by said tool, said front end portion being an elongated abutment piece.

5. The device of claim 4, each of said component bracing means further including a bellows-like covering for enclosing said threaded spindle between said abutment piece and gear means.

* * * * *